US006360552B1

(12) United States Patent
Lee et al.

(10) Patent No.: US 6,360,552 B1
(45) Date of Patent: Mar. 26, 2002

(54) FREEZING SYSTEM HAVING TWO VAPORIZERS FOR REFRIGERATOR

(75) Inventors: Won Hee Lee, Seoul; Il Nam Hwang, Ansan, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/691,128

(22) Filed: Oct. 19, 2000

(30) Foreign Application Priority Data

Oct. 19, 1999 (KR) ..... 99/45377

(51) Int. Cl.[7] ..... F25B 1/06
(52) U.S. Cl. ..... 62/200; 62/500
(58) Field of Search ..... 62/199, 200, 500, 62/513

(56) References Cited

U.S. PATENT DOCUMENTS 2,513,361 A * 7/1950 Rausch ..... 62/500
5,444,987 A * 8/1995 Alsenz ..... 62/500

* cited by examiner

*Primary Examiner*—William E. Tapolcai

(57) ABSTRACT

The present invention relates to a freezing system having two vaporizers for a refrigerator constructed as a single-loop cycle which is capable of using a genuine coolant as well as a mixed coolant by providing the coolant to a compressor after mixing the each coolant passed through a freezing chamber vaporizer and a chilling chamber vaporizer and heightening the pressure. The present invention comprises a compressor, a condenser for condensing the coolant compressed at the compressor, a freezing chamber expanding mean and a chilling chamber expanding mean for depressing the condensed coolant as a first pressure and a second pressure, a freezing chamber vaporizer and a chilling chamber vaporizer for cooling the air to be provided to the freezing chamber and chilling chamber as a first temperature and a second temperature by vaporizing the coolant expanded at the freezing chamber expanding mean and chilling chamber expanding mean, and an ejector for providing the coolant to the compressor after mixing the each coolant passed through the freezing chamber vaporizer and chilling chamber vaporizer and heightening the pressure.

6 Claims, 6 Drawing Sheets

FREEZING SYSTEM HAVING TWO VAPORIZERS FOR REFRIGERATOR

BACKGROUND OF THE INVENTION

1. Field of the Invention

The present invention relates to a freezing system having two vaporizers for a refrigerator, in particular to a freezing system having two vaporizers for a refrigerator which is capable of providing a coolant to a compressor after mixing the each coolant passed through a freezing chamber vaporizer and a chilling chamber vaporizer and heightening the pressure.

2. Description of the Prior Art

As depicted in FIG. 1, the conventional freezing system for a refrigerator comprises a compressor 1 for converting a coolant into high temperature and high pressure vapor state by compressing the coolant, a condenser 2 for condensing the high temperature and high pressure vapor state coolant passed through the compressor 1 into a high pressure liquid state and at the same time rising a temperature of the surrounding air by performing the heat-exchange with the surrounding air, an expanding unit 4 for decompressing the high pressure liquid state coolant passed through the condenser 2 in order to vaporize easily, and a vaporizer 5 for converting the coolant passed through the expanding unit 4 into a low temperature and low pressure vapor state and at the same time lowering the temperature of the surrounding air by performing the heat-exchange with the surrounding air.

The compressor 1 and condenser 2 are installed on a machine room (not shown) of the refrigerator, a radiating fan 3 for radiating the condenser 2 and a motor 7 for providing a power to the radiating fan 3 are installed on the side of the condenser 2

In addition, the vaporizer 5 is installed on the rear side of a freezing chamber 8 of the refrigerator, and provides the cooling air to the freezing chamber 8 and a chilling chamber 9, a freezing fan 6 for absorbing the heat of the vaporizer 5 and a motor 10 for providing the power to the freezing fan 6 are installed on the side of the vaporizer 5.

The operation and effect of the freezing system of the conventional refrigerator will now be described with reference to accompanying FIG. 2.

First, a low temperature and low pressure state coolant a is converted into a high temperature and high pressure vapor state coolant b by being compressed by the compressor 1, and is soaked into the condenser 2, the condenser 2 changes the high temperature and high pressure vapor state coolant b into high temperature and high pressure liquid state c or of by releasing the heat continually.

A certain part of the coolant condensed by the condenser 2 is expanded as isenthalpic by being decompressed while passing through the expanding unit 4, and is changed into a quarter-phase state d mixed with the liquid and gas After that, the coolant soaked into the vaporizer 5 totally vaporizes, is changed into the low temperature and low pressure state a or ag, and cools the surroundings by taking the heat of the surroundings during the vaporization.

The air cooled by the vaporizer 5 flows into the freezing chamber 8 and chilling chamber 9 through a cooling air duct (not shown) and a flow regulator (not shown), accordingly the each temperature of the freezing chamber 8 and chilling chamber 9 is stably kept as −18° C. and 4° C.

However, the conventional freezing system of the refrigerator cools the freezing chamber and chilling chamber as different temperature with only one vaporizer installed on the rear side of the freezing chamber, accordingly the energy efficiency of the refrigerator lowers because compression work of the compressor increases by the increase of the pressure difference between the vaporizer and condenser by setting the evaporating pressure of the coolant in the vaporizer according to the saturation temperature of the freezing chamber lower than the temperature of the chilling chamber.

In addition, in the conventional freezing system of the refrigerator, while the air cooled by the vaporizer is separately provided to the freezing chamber and chilling chamber, the air of the freezing chamber and chilling chamber can be mixed each other, moisture and food odor of the chilling chamber can flow into the freezing chamber, accordingly amenity of the refrigerator lowers.

In addition, in the conventional freezing system of the refrigerator, because of the moisture flowed from the chilling chamber a frost layer is formed on the surface of the vaporizer having very low temperature, accordingly the heat transmission efficiency of the vaporizer lowers, and at the same time air volume passing through the vaporizer decreases.

In addition, in the conventional freezing system of the refrigerator, a defrost system using an electronic heater is required in order to remove the frost layer formed on the surface of the vaporizer, the electronic heater consumes about 5~10% of the total electric consumption, accordingly the system efficiency lowers.

In the meantime, in order to solve the above-mentioned problems, the freezing system having the two vaporizers is developed.

There are different types of the freezing system having the two vaporizer, among them a dual-loop cycle and a single-loop cycle can be represented.

The dual-loop cycle comprises independent two freezing cycles having each different vaporizing temperature, it is good for the energy efficiency because the compression work of the compressor decreases drastically by reducing the pressure difference of the condenser by generating the high evaporating pressure, but it has to use the two compressors and two vaporizers, accordingly its usefulness lowers due to the increase of the supplementary expense.

The single-loop cycle can be represented as a Lorentz-Meutzner cycle which uses one compressor and two vaporizers, it does not have the efficiency lowering problem due to the increase of the supplementary expense because only one vaporizer is additionally installed, however a mixed coolant is required for this type, accordingly the usable mixed coolant has to be developed first, and can be provided cheaply.

SUMMARY OF THE INVENTION

The object of the present invention is to provide a freezing system having two vaporizers for a refrigerator which is capable of maximizing the energy efficiency with minimum supplementary expense by constructing a single-loop cycle usable with a genuine coolant as well as a mixed coolant by providing a coolant to a compressor after mixing the coolant separately passed through a freezing chamber vaporizer and a chilling chamber vaporizer through an ejector and heightening the pressure.

In order to achieve the above-mentioned object, the present invention comprises a compressor for compressing the coolant, a condenser for condensing the coolant compressed at the compressor, an expanding mean for the freezing chamber for depressing the coolant condensed at the condenser as a second pressure, an expanding mean for the chilling chamber for depressing the coolant condensed at the condenser as a second pressure, a vaporizer for the freezing chamber for cooling the air to be provided to the freezing chamber as a first temperature by vaporizing the coolant expanded at the expanding mean for the freezing chamber, a vaporizer for the chilling chamber for cooling the air to be provided to the chilling chamber as a second temperature by vaporizing the coolant expanded at the expanding mean for the chilling chamber, and an ejector for providing the coolant to the compressor after mixing the coolant passed through the vaporizer for the freezing chamber and vaporizer for the chilling chamber and compressing it.

DETAILED DESCRIPTION OF THE PREFERRED EMBODIMENT

Hereinafter, the preferred embodiments of a freezing system of a refrigerator according to the present invention will now be described with reference to accompanying drawings.

Figure 1:
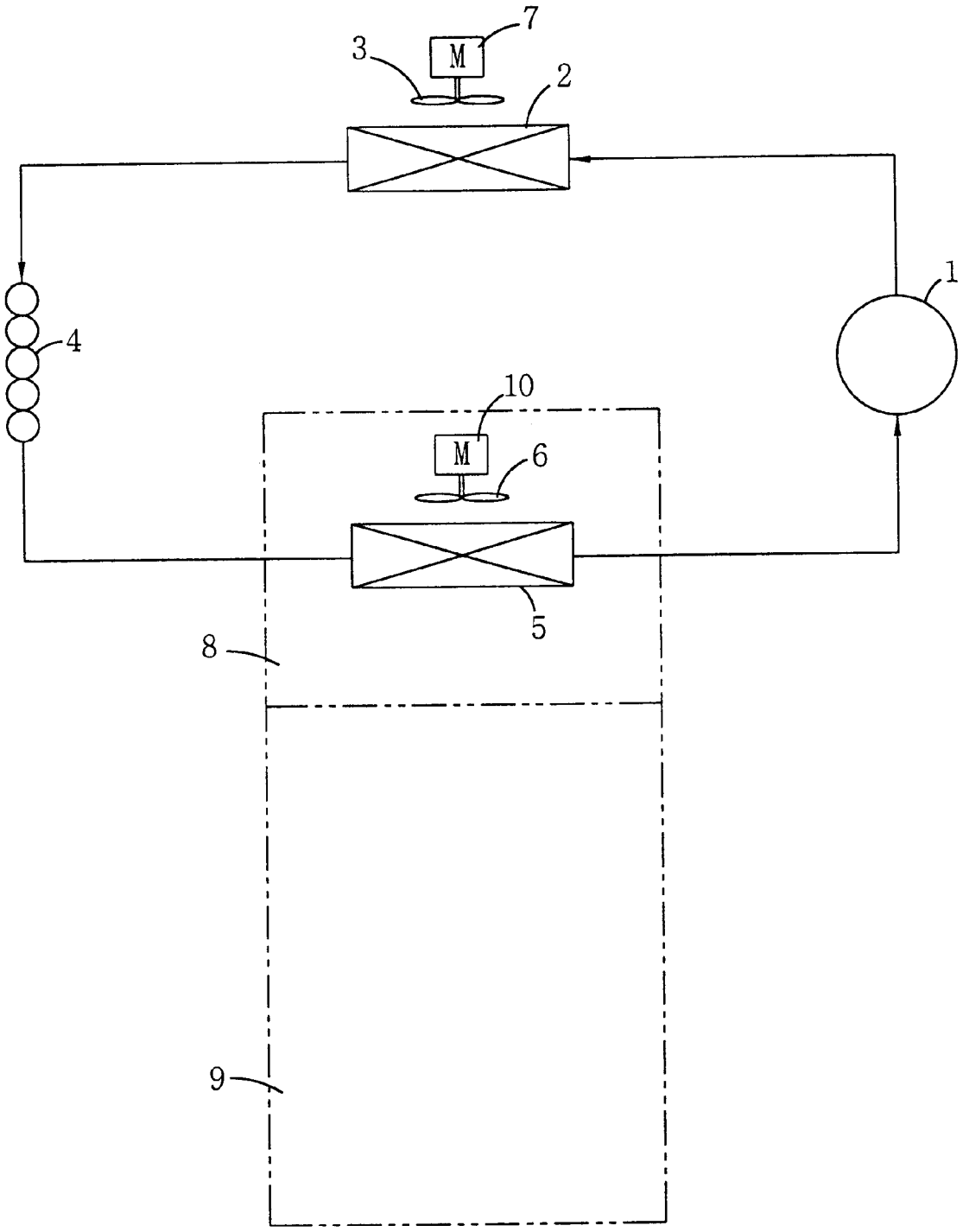
FIG. 1 BACKGROUND ART
FIG. 1 is a schematic block diagram illustrating the conventional freezing system of a refrigerator.
Figure 2:
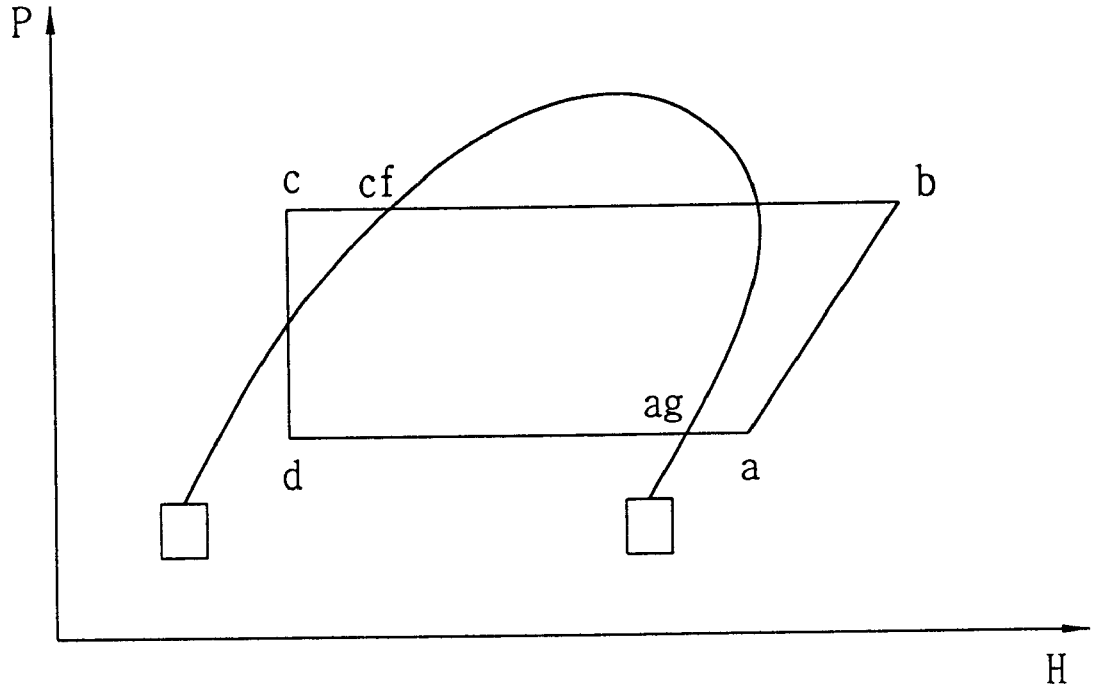
FIG. 2 BACKGROUND ART
FIG. 2 is a graph illustrating a pressure-enthalpy chart of the conventional freezing system.

Parts overlapping with the construction parts of FIG. 1 will be described with the same reference numerals.

The present invention can be embodied many ways, hereinafter the preferred embodiments will now be described.

The object, character, and effects of the present invention will be better understood with the preferred embodiments.

Figure 3:
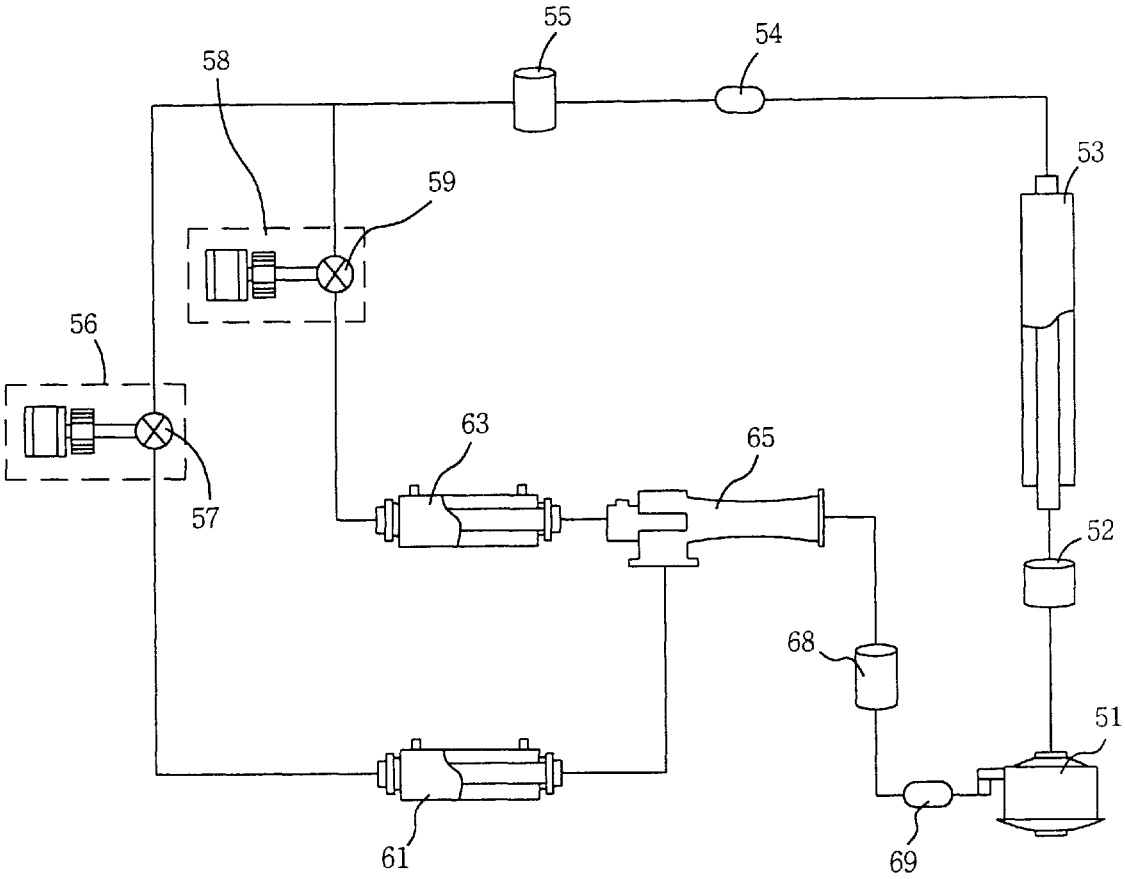
FIG. 3 is a block diagram illustrating a freezing system having two vaporizers for a refrigerator according to the first embodiment of the present invention.

As depicted in FIG. 3, the first embodiment of the freezing system of the refrigerator according to the present invention comprises a compressor 51 for compressing the coolant, a condenser 53 for condensing the coolant compressed at the compressor 51, a freezing chamber expanding mean 56 for decompressing the coolant condensed at the condenser 53 as a first pressure, a chilling chamber expanding mean 58 for decompressing the coolant condensed at the condenser 53 as a second pressure, a freezing chamber vaporizer 61 for cooling the air to be provided to the freezing chamber 8 as a first temperature by vaporizing the coolant expanded at the freezing chamber expanding mean 56, a chilling chamber vaporizer 63 for cooling the air to be provided to the chilling chamber 9 as a second temperature by vaporizing the coolant expanded at the chilling chamber expanding mean 58, and an ejector 65 for providing the coolant to the compressor 51 after mixing the each coolant passed through the freezing chamber vaporizer 61 and chilling chamber vaporizer 63 and heightening the pressure.

Herein, the freezing chamber expanding mean 56 and chilling chamber expanding mean 58 is separately constructed as an electron expansion valve 57, 59 in order to adjust the flow quantity of the coolant flowed from the condenser 53 to the freezing chamber vaporizer 61 and chilling chamber vaporizer 63.

Meanwhile, a radiating fan (not shown) for releasing the heat of the condenser 53 is installed on the side of the condenser 53, each heat absorption fan (not shown) for absorbing the heat of the each vaporizer 61, 63 is separately installed on the side of the freezing chamber vaporizer 61 and chilling chamber vaporizer 63, and a motor (not shown) for providing the power is connectedly installed on the radiating fan and heat absorption fan.

Figure 4:
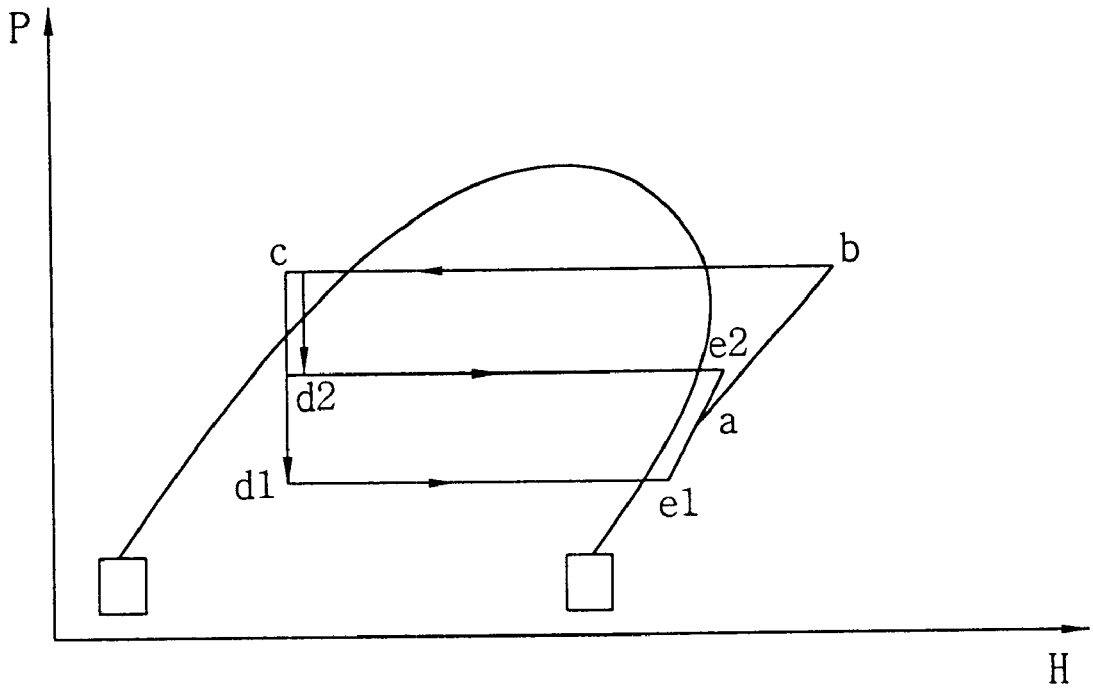
FIG. 4 is a graph illustrating the pressure-enthalpy chart of the freezing system according to the present invention.

The freezing system of the refrigerator according to the present invention will now be described with reference to FIG. 4.

First, a low temperature and low pressure state coolant a is compressed by the compressor 1, is changed into the high temperature and high pressure vapor state b, is flowed into the condenser 53, and the coolant b is changed into a normal temperature and high pressure liquid state c by releasing the heat at the condenser 53.

After that, the quantity of the coolant passed through the condenser 53 is determined according to the load set on the freezing chamber 8 and chilling chamber 9, and is separately flowed into the freezing chamber expanding mean 56 and chilling chamber expanding mean 58.

Herein, the freezing chamber expanding mean 56 and chilling chamber expanding mean 58 adjust the flow quantity of the coolant corresponding to the load of the freezing chamber 8 and chilling chamber 9 in order to provide the appropriate quantity of the coolant to the freezing chamber vaporizer 61 and chilling chamber vaporizer 63.

After that, the coolant passed through the freezing chamber expanding mean 56 is depressed as a first pressure state d1, the coolant passed through the chilling chamber expanding mean 58 is depressed as a second pressure d2, the coolant is expanded as the isenthalpic while passing the freezing chamber expanding mean 56 and chilling chamber expanding mean 58, and the coolant is changed into a two-phase state mixed with the liquid and gas.

The coolant passed through the freezing chamber expanding mean 56 and chilling chamber expanding mean 58 is changed into the low temperature and low pressure state coolant e1, e2 while it is totally vaporized after being separately flowed into the freezing chamber vaporizer 61 and chilling chamber vaporizer 63, and the coolant cools the surrounding air as the first temperature and second temperature by absorbing the surrounding heat.

The air cooled as the set temperature by the freezing chamber vaporizer 61 and chilling chamber vaporizer 63 is separately provided to the freezing chamber 8 and chilling chamber 9 through a cooling air duct (not shown) and a flow regulator (not shown).

Herein, flow channels of the cooling air provided to the freezing chamber 8 by the freezing chamber vaporizer 61 and cooling air provided to the chilling chamber 9 by the chilling chamber vaporizer 63 are divided, accordingly the cooling air of the freezing chamber 8 and chilling chamber 9 can not be mixed.

After that, the pressure of the low temperature and low pressure gas state coolant passed through the freezing chamber vaporizer 61 and chilling chamber vaporizer 63 heightens by being flowed into the ejector 65 and being mixed together, the coolant compressed by the ejector 65 is flowed into the compressor 51, and above process is performed repeatedly.

A non-described reference numeral 52 is an oil-separator installed between the compressor 51 and condenser 53 for separating the oil from the coolant in order to make the only coolant flow into the condenser 53, the reference numeral 54 and 55 are driers separately installed on the coolant outlet of the condenser 53 for removing the moisture included in the coolant, and a receiver for adjusting the flow quantity of the coolant according to the load of the freezing chamber 8 and chilling chamber 9.

In addition, a reference numeral 68 is an accumulator installed on the coolant inlet of the compressor 51 for separating the gas state coolant and liquid state coolant in order to get only the gas state coolant be flowed into the compressor 51, and a reference numeral 69 is a strainer installed on the coolant inlet of the compressor 51 for removing impurities included in the coolant.

Figure 5:
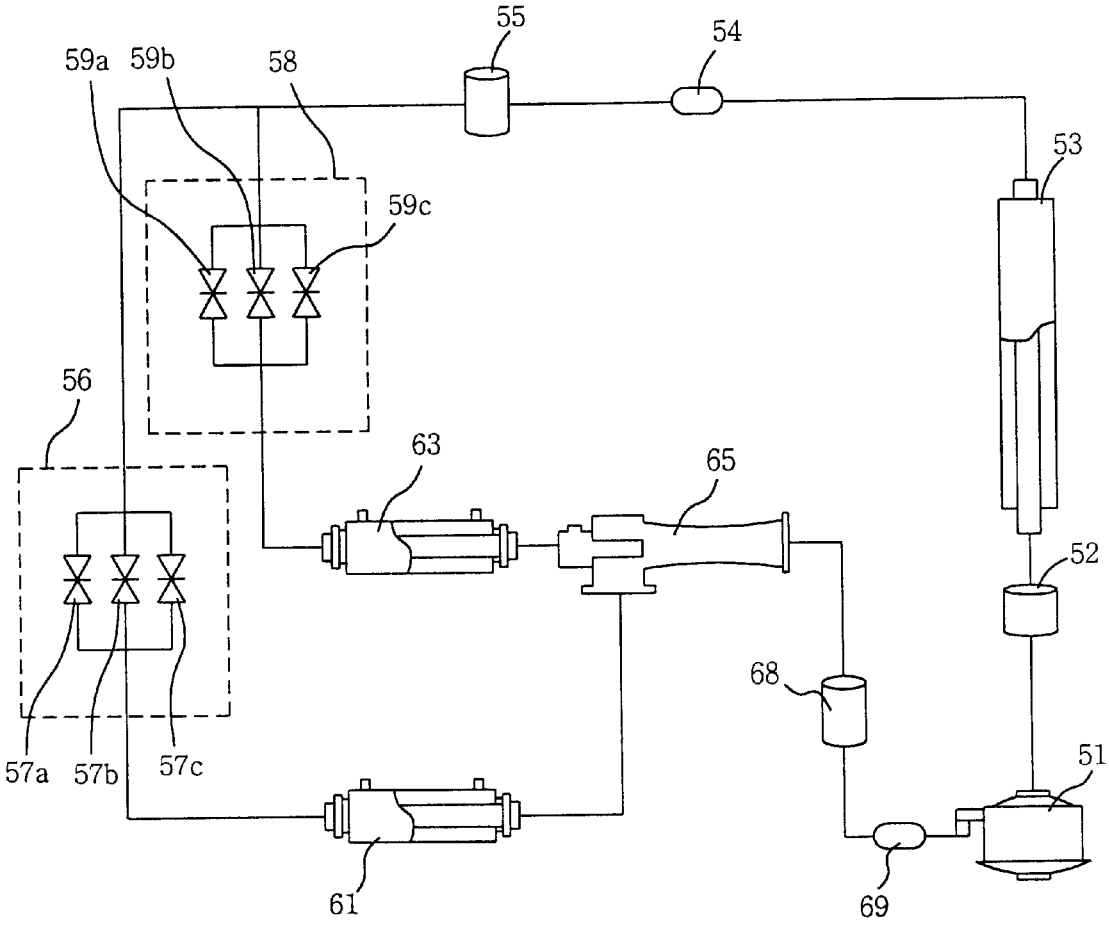
FIG. 5 is a block diagram illustrating the freezing system of the refrigerator according to the second embodiment of the present invention.

Meanwhile, as depicted in FIG. 5, in the second embodiment of the present invention, the freezing chamber expanding mean 56 and chilling chamber expanding mean 58 comprises a plurality of capillary tubes 57*a*, 57*b*, 57*c*, 59*a*, 59*b*, 59*c*. The number of the capillary tube is illustrated as three per each expanding mean in FIG. 5, but it can be changed variously.

The each capillary tubes 57*a*, 57*b*, 57*c*, 59*a*, 59*b*, 59*c* comprised in the expanding means 56, 58 is separately diverged in order to change the flow channel of the coolant in accordance with the each load set on the freezing chamber 8 and chilling chamber 9, orifices can be used on the behalf of the capillary tubes in the modification of the present invention.

The each expanding mean 56, 58 comprising the plurality of the capillary tubes 57*a*, 57*b*, 57*c*, 59*a*, 59*b*, 59*c* can change the flow channel of the coolant in accordance with the load of the freezing chamber 8 and chilling chamber 9 because of the plurality of the capillary tubes can be separately diverged.

Figure 6:
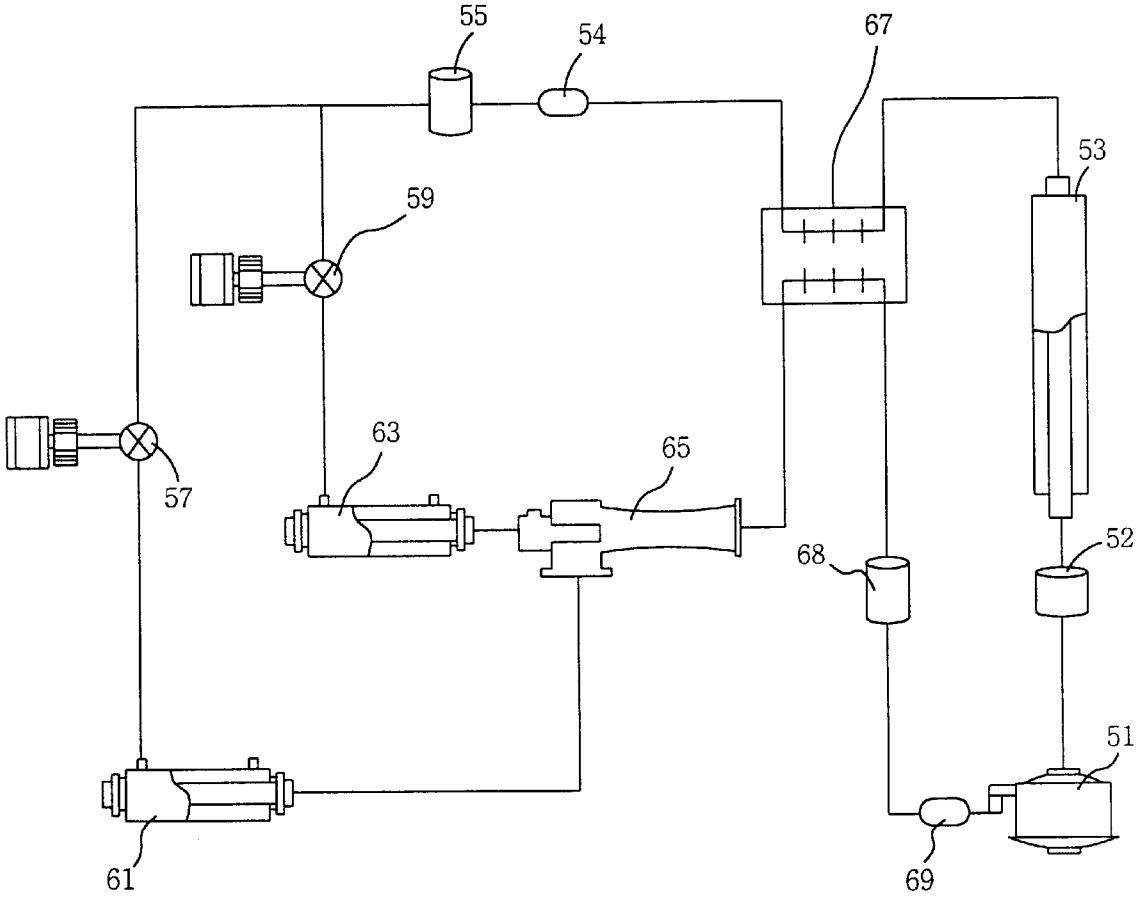
FIG. 6 is a block diagram illustrating the freezing system of the refrigerator according to the third embodiment of the present invention.

Meanwhile, as depicted in FIG. 6, in the third embodiment of the present invention, a pre-heater 67 is installed between the ejector 65 and compressor 51 in order to rise the temperature of the coolant before the coolant is flowed into the compressor 51.

Herein, the pre-heater 67 heats the coolant passed through the ejector 65 by performing the heat-exchange of the low temperature coolant passed through the ejector 65 with the high temperature coolant passed through the vaporizer 53.

As described above, when the heat-exchange is performed between the coolant passed through the condenser 53 and the coolant passed through the ejector 65 by the pre-heater 67, the coolant passed through the condenser 53 is overcooled and is flowed into the each expanding mean 56, 58, the coolant passed through the ejector 65 is overheated and is flowed into the compressor 51, accordingly the pre-cooler 67 can largely help to improve the energy efficiency of the freezing system.

As described above, the freezing system having the two vaporizers for the refrigerator according to the present invention is capable of maximizing the energy efficiency with the minimum supplementary expense by constructing the single-loop cycle adaptable to the genuine coolant by providing the coolant to the compressor after mixing the coolant passed through the freezing chamber vaporizer and chilling chamber vaporizer through the ejector and heightening the pressure.

As the present invention may be embodied in several forms without departing from the spirit or essential characteristics thereof, it should also be understood that the above-described embodiments are not limited by any of the details of the foregoing description, unless otherwise specified, but rather should be constructed broadly within its sprit and scope as defined in the appended claims, and therefore all changes and modifications that fall within the meets and bounds of the claims, or equivalence of such meets and bounds are therefore intended to be embraced by the appended claims.

What is claimed is:

1. A freezing system having two vaporizers for a refrigerator, comprising:

a compressor for compressing a coolant, a condenser for condensing the coolant compressed at the compressor, a freezing chamber expanding mean for decompressing the coolant condensed at the condenser as a first pressure, a chilling chamber expanding mean for decompressing the coolant condensed at the condenser as a second pressure, a freezing chamber vaporizer for cooling the air to be provided to a freezing chamber as a first temperature by vaporizing the coolant expanded at the freezing chamber expanding mean, a chilling chamber vaporizer for cooling the air to be provided to a chilling chamber as a second temperature by vaporizing the coolant expanded at the chilling chamber expanding mean; and an ejector for providing the coolant to the compressor after mixing the each coolant passed through the freezing chamber vaporizer and chilling chamber vaporizer and heightening the pressure;

wherein the freezing and chilling vaporizers further comprise a pre-heater installed between the ejector and compressor.

2. The freezing system having the two vaporizers for the refrigerator according to claim 1, wherein the freezing chamber expanding mean and chilling chamber expanding mean are electronic expansion valves.

3. The freezing system having the two vaporizers for the refrigerator according to claim 1, wherein the freezing chamber expanding mean and chilling chamber expanding mean separately comprise a plurality of capillary tubes.

4. The freezing system having the two vaporizers for the refrigerator according to claim 1, wherein the freezing chamber expanding mean is constructed as the electronic expansion valve, and the chilling chamber expanding mean is constructed as the plurality of the capillary tubes.

5. The freezing system having the two vaporizers for the refrigerator according to claim 1, wherein the freezing chamber expanding mean is constructed as the plurality of capillary tubes, and the chilling chamber expanding mean is constructed as the electronic expansion valve.

6. The freezing system having the two vaporizers for the refrigerator according to claim 1, wherein the pre-heater performs the heat exchange between the low temperature coolant passed through the ejector and high temperature coolant passed through the condenser.

* * * * *